United States Patent [19]

Dimopoulos

[11] 4,068,836

[45] Jan. 17, 1978

[54] MANUAL PAPER COLLATOR

[75] Inventor: George H. Dimopoulos, Park Ridge, Ill.

[73] Assignee: Michael Business Machines Corporation, New York, N.Y.

[21] Appl. No.: 694,233

[22] Filed: June 9, 1976

[51] Int. Cl.[2] ..... B65H 39/05

[52] U.S. Cl. ..... 270/58

[58] Field of Search ..... 270/58

[56] References Cited

U.S. PATENT DOCUMENTS

| | | | |
|---|---|---|---|
| 2,599,829 | 6/1952 | Hernblad | 270/58 |
| 3,664,656 | 5/1972 | Ryland | 270/58 |

*Primary Examiner*—E. H. Eickholt
*Assistant Examiner*—A. Heinz
*Attorney, Agent, or Firm*—Lawrence S. Lawrence

[57] ABSTRACT

A manually operable collator is provided for assembling multiple paper sheets in sequential order, comprising a housing, having a plurality of paper receiving trays and reciprocally movable means for simultaneously transporting the top sheet of paper in each tray from the housing, including a plurality of pusher arms extending into each of said trays and adapted to engage said top sheets of paper. A paper guide is pivotally mounted on the front of the housing below the paper receiving trays and is adapted to guide the paper sheets transported from the trays to facilitate the gathering of such sheets. In addition, means are provided, linking the pusher arms and the pivotal paper guide, to lift the pusher arms out of engagement with the paper in each tray upon the downward pivotal movement of said paper guide to permit the loading of paper into said trays.

8 Claims, 3 Drawing Figures

MANUAL PAPER COLLATOR

BACKGROUND OF THE INVENTION

Collators used for the purpose of assembling pages of written or printed material in numerically consecutive order have been in wide spread use for quite some time. However, many of such collators are expensive motor driven devices, which are often unsuitable for use in small offices due to their high cost and high productivity. Accordingly, there has been a growing need for an inexpensive, manually operated collator, and in recent years such collators have become available. Unfortunately, such manual collators usually suffer from operational deficiences, which render them inconvenient to use, such as the inability to properly guide and efficiently gather multiple sheets of paper as they are transported from the collator, and the inability to easily load the collator with stacks of paper due to the interfering position of the pusher means for transporting such paper.

In certain of the more expensive motor driven automatic collators found in the prior art means have been provided to guide the paper sheets as they are discharged, but it has been found that such means, which are usually in the form of plates or trays fixedly mounted to the exterior of the collator are not always suitable for use in the manual collators due to variations in the stiffness of the paper sheets and the speed at which such sheets are discharged. Similarly, means have also been provided in some automatic collators to raise the pusher means out of engagement with the top sheet of paper in each stack within the collator to facilitate the loading or reloading of additional sheets. However, such lifting means are usually automatically activated upon the reciprocating movement of the carriages used to carry the pusher means at the end of a paper transporting stroke, and as such are either inconvenient or too expensive for use in a manual collator.

Examples of motor driven collators having these features can be found in U.S. Pat. No. 3,269,721 to Taylor et al and U.S. Pat. No. 3,463,481 to Thomas et al and the patents cited therein. In those instances where the prior art teaches mechanisms for disengaging the pusher means independently of the reciprocable movement of such pusher means, such as in U.S. Pat. No. 3,664,656 to Ryland, it has also been found that such mechanisms are far too complex and expensive to be efficiently utilized in manual collators.

SUMMARY OF THE INVENTION

In accordance with the present invention an inexpensive manual desk top collator is provided which overcomes the aforementioned deficiencies found in existing manual collators by including adjustable means for guiding sheets of papers discharged therefrom to facilitate gathering the same, and means for disengaging the paper transporting means to facilitate loading of paper into the various trays thereof independently of the movement of said transporting means. The guide means is in the form of a tray or plate pivotally mounted at the front of the collator to permit adjustments in its position, and, in addition, is operatively linked to the paper transporting disengaging means, so that the pivotal movement of said guide means between certain positions actuates and de-actuates the disengaging means.

The collator of the invention comprises, in combination, a housing having a plurality of vertically spaced apart trays for receiving stacks of paper sheets; manually operable means for simultaneously transporting the top sheet of paper from each of said trays to the exterior of the housing, including a plurality of reciprocably movable pusher arms each extending into an individual tray and adapted to engage said top sheets of paper in said trays; paper guide means disposed at the front of the housing below the paper receiving trays and pivotally movable to facilitate gathering the paper sheets transported from said trays; disengaging means adapted to lift said pusher arms out of contact with the paper in each tray; and linking means operatively connecting said guide means and said disengaging means, whereby downward pivotal movement of the guide means activates the disengaging means to permit loading of the collator.

The paper guide means preferably comprises a generally rectangularly shaped flat sheet or tray formed of rigid sheet metal. The sheet has a pair of parallel depending ears formed along opposite edges at one end thereof, which ears have suitable openings to permit the pivotal attachment of the sheet to the side walls of the collator housing, and to the linking means. The guide is adapted to support the various sheets of paper as they are simultaneously transported from each of the trays of the collator in a manner such that the leading edges of such sheets converge and thereby may be gathered by the operator by grasping the same between the thumb and the forefinger. The position in which the guide means need be placed to properly support and guide the sheets for efficient gathering as they are discharged depends upon the thickness or rigidity of the paper sheets and the speed at which such sheets are transported from the collator. However, the pivotal nature of the guide means permits adjustment to any desired position.

Each of the pusher arms of the transporting means is pivotally connected to a common elongated mounting bracket disposed perpendicularly to the trays. The disengaging means for lifting said pusher arms out of engagement with the paper stack comprises an elongating lifting bracket slidably disposed on the mounting bracket and having a series of lifting pins extending therefrom perpendicularly to the pusher arms, each of said pins being adapted to contact an individual pusher arm, and an actuating arm pivotally mounted on the bottom of the collator housing and adapted to contact the end of the lifting bracket to slidably move the same along the mounting bracket. The lifting pins are preferably in the form of torsion springs to absorb movement in the event that one or more of the pusher arms contact the tray above before one or more other pusher arms fully disengage the paper stacks in their respective trays, without causing a stoppage in the lifting operation. The linking means preferably comprises an elongated bar extending between and pivotally connected to the ears of the guide means and one corner of the actuating arm, so that downward pivotal movement of the guide means causes upward pivotal movement of the actuating arm, thereby engaging the lifting bracket to disengage the pusher arms.

It should be noted that the mounting bracket and the lifting bracket are reciprocally movable together with the pusher arms, so that the lifting bracket is only in a position for engagement by the actuating arm at the end of a paper transporting stroke. This permits adjustment of the position of the guide means during the movement of the paper sheets without disengaging the pusher arms.

The collator of the invention is more fully described with reference to the accompanying drawings.

DETAILED DESCRIPTION OF PREFERRED EMBODIMENT

Figure 1:
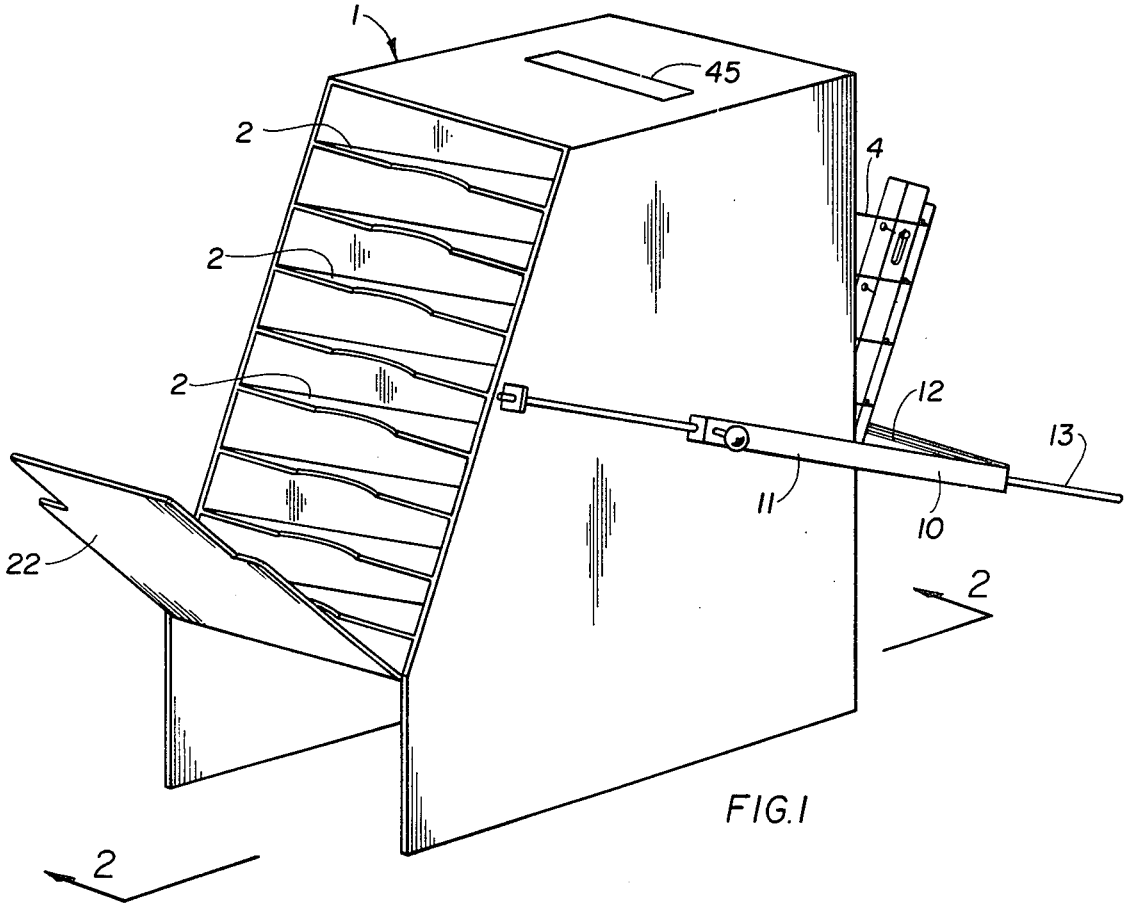
FIG. 1 is a side perspective view of the collator of the invention.
Figure 2:
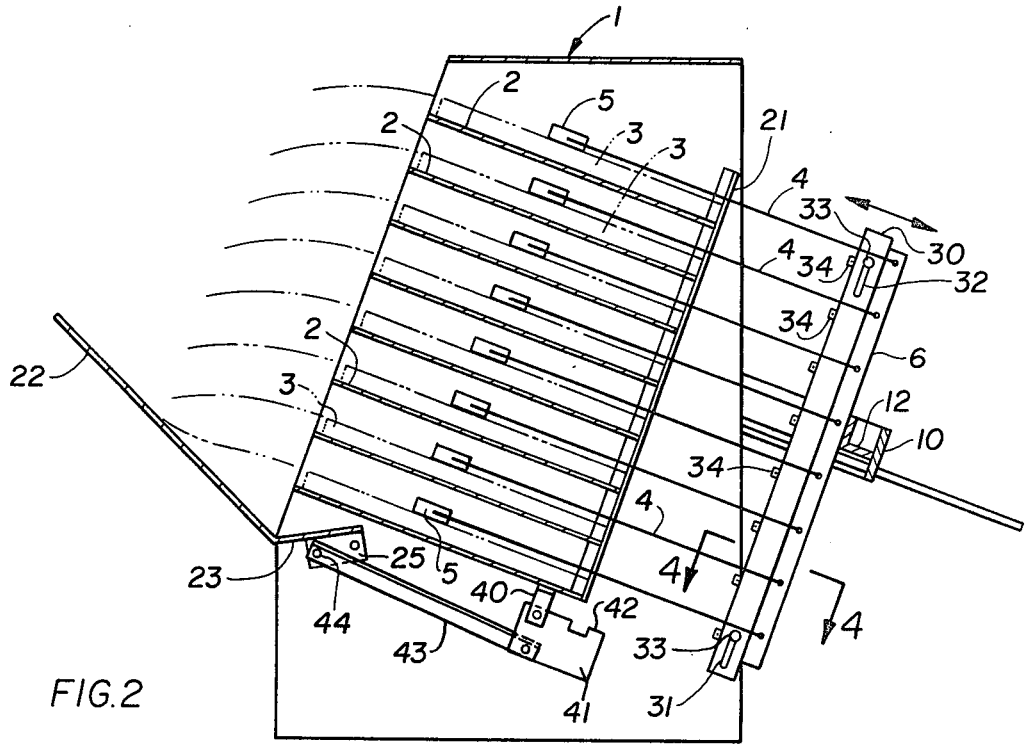
FIG. 2 is a cross-sectional view of the collator taken along the lines 2—2 of FIG. 1.

Referring now to the drawings, and in particular FIGS. 1 and 2, it can be seen that the collator of the invention comprises a housing 1 having a series of eight parallel vertically spaced trays 2 for receiving stacks of paper sheets 3. The trays 2 are fixedly disposed within the housing at angle with respect to the horizontal to assure that the stacks of paper 3 therein do not slide out of the housing. Paper stops 20 and 21 (best seen in FIGS. 2 and 5) disposed at the rear of trays 2 maintain the paper in proper alignment. It should be noted that although the collator illustrated in the drawings has eight paper receiving trays, such number can be increased or decreased as desired.

Figure 4:
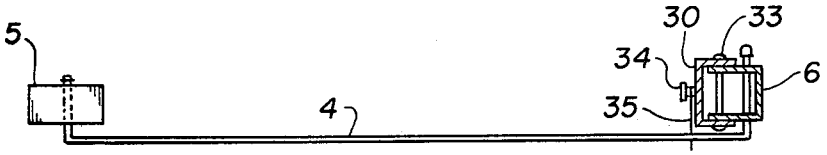
FIG. 4 is a partial cross-sectional view of the pusher arm lifting mechanism taken along the lines 4—4 of FIG. 2.

Associated with and extending into each paper receiving tray 2 are a corresponding series of eight elongated pusher arms 4, each having a gravity biased paper engaging finger 5, in the form of a rubber or other high friction material pad, pivotally attached to the distal ends thereof. The opposite end of each pusher arm 4 is pivotally connected to an elongated mounting bracket 6, which forms a part of the transport means adapted to reciprocally move pusher arms 4 within the trays 2. The pivotal connection between pusher arms 4 and mounting bracket 6 is best seen in FIG. 4.

Figure 5:
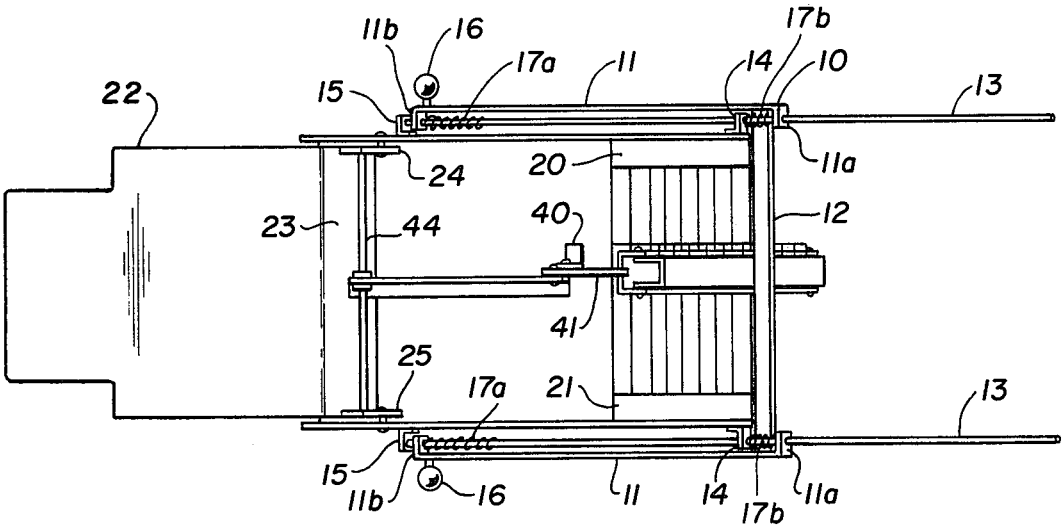
FIG. 5 is a bottom view of the collator showing the linkage between the guide means and pusher arm lifting mechanism.

The bracket 6 is fixedly connected at its midpoint to a U-shaped carriage assembly 10 slidably mounted on the sides of housing 1, as shown in FIGS. 1 and 5. The carriage 10 comprises a pair of side bars 11 and a rear bar 12. The bars 11 each have depending flanges **11*a* and 11*b* disposed at the ends thereof. A pair of rods 13 which slidably engage suitable openings formed in flanges 11*a* and 11*b* of the bars 11 serve as tracks on which the carriage assembly rides. The rods 13 are fixedly connected to the sides of housing 1 by means of angle brackets 14 and 15. Helical springs 17*a* and 17*b* are disposed around each rod 13 between angle bracket 14 and flanges 11*b* and 11*a*, respectively, on both sides of housing 1, to absorb any shock attributable to the rapid movement of the carriage assembly 10 at both ends of its travel. Each bar 11 has a handle 16 connected thereto to permit manual reciprocal movement of the carriage assembly 10** to effectuate the collating operation.

To facilitate the gathering of the paper sheets as they are transported from each of the trays of the collator, a guide tray 22 is pivotally connected to the front of the housing 1 in a position immediately below the lowermost paper receiving tray 2. As shown in FIG. 2, the paper guide tray 22 can be moved into a position approximately 30° to 60° above horizontal, so that it forces the individual sheets of paper to converge as they are discharged from the collator, thus enabling the operator to easily gather the same.

The guide tray 22 is in the form of a flat rectangular plate having an angular upwardly extended section 23 at the innermost end thereof. Depending from angular section 23 on both sides thereof are flanges 24 and 25, best seen in FIG. 5. Securing means, such as rivets or screws, are utilized to pivotally connect guide tray 22 via flanges 24 and 25 to the inside of the side walls of housing 1. In this manner, the guide tray 22 is movable into the desired angular position. Detent means (not shown) can be provided on each of the flanges 24 and 25 to engage suitable depressions in the side walls of the housing 1, to secure the guide tray 22 in the desired angular position. Alternatively, the width of the guide tray 22 can be made such that flanges 24 and 25 snuggly fit within the side walls of housing 1, so that the friction between the flanges 24 and 25 of said side walls will maintain the guide tray in the desired position.

The disengaging means for raising the pads 5 of pusher arms 4 out of contact with trays 2 or the paper in such trays to facilitate the loading of additional paper comprises a lifting bracket 30 in the form of an elongated bar having a U-shaped cross-section slidably mounted along the sides of pusher arm mounting bracket 6. As shown in FIG. 4, pusher arm mounting bracket 6 is also in the form of an elongated U-cross-section bar, the width of which is slightly less than the distance between the flanges of lifting bracket 30. The flanges of bracket 30 have slotted openings 31 and 32 formed at the extreme ends thereof as shown in FIG. 2, and are thereby connected to the corresponding flanges of mounting bracket 6 by rivets or pins which slidably extend through slotted openings 31 and 32. In this manner, bracket 30 is movable along rivets 33 over a distance corresponding to the length of slots 31 and 32.

A series of spaced apart pins 34 are mounted on the face of bracket 30 and positioned slightly below each pusher arm 4 as shown in FIG. 2. Connected to each pin 34 is a torsion spring lifting finger 35 which extends from pin 34 perpendicularly to the corresponding pusher arm 4 and is normally disposed below the pusher arm when the bracket 30 is at the lowest end of its travel along pin 33. It can be seen in FIGS. 2 and 4 that upward movement of bracket 30 causes fingers 35 to engage the corresponding pusher arms 4 and thereby lift such pusher arms so that the paper engaging pads 5 are raised out of engagement with the top sheet of the paper in each paper receiving tray 2. By utilizing torsion springs for fingers 35, stoppage of the lifting means is avoided in the event that one or more pusher arms 4 contact a tray 2 above it before another pusher arm has disengaged its respective paper stack.

An L-shaped bracket 40 is fixedly attached to the housing 1 below the rearmost edge of the lowermost paper receiving tray 2. An arm 41 having a lifting finger 42 is pivotally connected to bracket 40 by means of a suitable fastening device. A linkage 43 in the form of an elongated angle iron is pivotally connected to one corner of lifting arm 41. The opposite end of such linkage 43 is pivotally connected to a cylindrical bar 44 or other suitable means, such as another L-shaped bracket, extending between flanges 24 and 25 of the guide tray 22.

Figure 3:
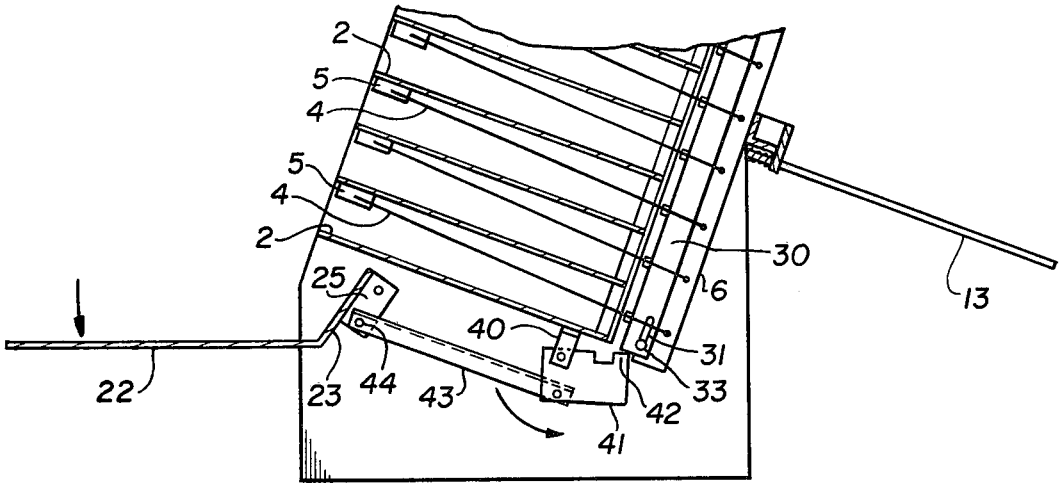
FIG. 3 is a partial cross-sectional view of the collator showing the means for disengaging the pusher arms in its operative position.

It can be seen in FIGS. 2 and 3 that downward pivotal movement of the guide tray 22 to a position below horizontal causes corresponding upward pivotal movement of the lifting finger 42 of arm 41.

When the carriage 10 is at the end of a paper transporting stroke, bracket 30 is in alignment with arm 41, so that finger 42 will be in a position to hook or otherwise contact the bottom of bracket 30 to slidably raise such bracket and thereby place the collator in condition for loading by raising the pusher arms out of engagement with the stacks of paper 3.

The collator is relatively small and light weight and as such can be conveniently moved. For such purpose a handle 45 on the top of housing 1 is provided.

In use, the operator first slidably moves carriage 10 to its fbrward most position by means of one or both handles 16. Such position is shown in FIG. 5. Next, the paper guide tray 22, is pivotally lowered into the position shown in FIG. 3, so that arm 41 is pivotally moved and finger 42 engages lifting bracket 30. Such bracket is thereupon moved upwardly causing lifting fingers 35 to engage pusher arms 4 and raise pads 5 thereof out of engagement with the various trays 2 or the paper within such trays. The operator can then insert stacks of paper 3 into each of the paper receiving trays 2, by sliding such paper into such trays until it engages stop members 20 and 21. The guide tray 22 is then raised into the desired position to guide the paper sheets as they are discharged from the collator, and the collating process can commence by manually reciprocating carriage 10 which thereupon reciprocates each of the pusher arms within their respective paper receiving trays 2. As the pushers are transported forward within each tray, the pads 5 engage the top sheet of paper in each stack 3 and transport the same from the collator housing 1. The position of guide tray 22 cause the ends of the paper sheets to converge and thusly facilitates the gathering thereof.

Although the invention has been described with reference to a single embodiment, additional embodiments and modifications of the collator falling within the scope of this invention will be apparent to those skilled in the art.

What is claimed is:

1. A collator, comprising, in combination, a housing having a plurality of spaced apart trays for receiving and storing stacks of paper sheets; a reciprocal carriage disposed on the housing; a plurality of pusher arms pivotally mounted on said carriage, each extending into an individual paper receiving tray and adapted to engage the top sheet of paper in each said paper receiving tray; means for manually reciprocating said carriage to simultaneously transport the top sheet of paper from each of said paper receiving trays; paper guide means pivotally disposed on the housing below the paper receiving trays to engage the leading edge of the paper sheets transported from the trays to facilitate the gathering thereof; disengaging means disposed on said carriage for movement between a first position for normal operation and a second position for raising each of said pusher arms out of the engagement with the paper sheets within each tray to facilitate loading said trays; and linking means connected to the paper guide means for movement therewith, and adapted to move the disengaging means from its first position to its second position upon the downward pivotal movement of said guide means to raise the pusher arms.

2. A collator in accordance with claim 1, in which the paper guide means comprises a tray extending outwardly from the front of the housing, and pivotally movable from a below horizontal position for moving the disengaging means into its second position to a position within the range of approximately 30° to 60° above horizontal to urge the leading edges of the paper sheets to converge as said sheets are transported from the paper receiving trays.

3. A collator in accordance with claim 1, in which said carriage includes an elongated mounting bracket to which said pusher arms are each pivotally connected; and said disengaging means includes an elongated lifting bracket slidably attached to said mounting bracket, and a plurality of lifting pins disposed on said lifting bracket and adapted to contact the pusher arms, said lifting bracket being movable between said first position in which the lifting pins are out of engagement with the pusher arms, and said second position in which the lifting pins raise the pusher arms out of contact with the paper in the trays.

4. A collator in accordance with claim 3, in which each lifting pin comprises a torsion spring connected to said lifting bracket.

5. A collator in accordance with claim 3, in which the linking means comprises an actuating arm pivotally mounted within the housing and adapted to engage the lifting bracket to move the same into the second position.

6. A collator in accordance with claim 5, in which the linking means further comprises an elongated bar extending between and pivotally connected to the guide means and the actuating arm.

7. A manually operable collator for simultaneously gathering multiple sheets of paper comprising, in combination, a plurality of trays for receiving and storing stacks of paper sheets arranged according to a desired sequence of assembly; means for simultaneously transporting the top sheet of paper from each tray having elongated pivotally mounted pusher means extending into each of said trays to engage said top sheets of paper; adjustable guide means disposed adjacent said trays and pivotally movable between a paper loading position and a plurality of paper guiding positions in which said guide means is adapted to receive and converge the leading edges of the transported paper sheets to facilitate the gathering thereof; and means operatively linked to the guide means and the pusher means for pivotally lifting said pusher means out of engagement with said top sheets of paper when the guide means is moved to the paper loading position.

8. In a collator of the type having a plurality of paper receiving trays, and a corresponding plurality of gravity biased elongated pusher arms extending into said trays and adapted to simultaneously transport the top sheets of paper therefrom, the improvement comprising: selectively operable disengaging means for raising the pusher arms out of engagement with the paper to facilitate loading the trays; guide means disposed adjacent said trays and movable between a paper loading position, and one or more paper guiding positions in which the guide means receives and converges the leading edges of the paper sheets transported from the trays to facilitate the gathering thereof; and a control linkage operatively connecting the guide means and the disengaging means for moving the disengaging means to raise the pusher arms when the guide means is moved to the paper loading position.

* * * * *